United States Patent [19]

Akihama et al.

[11] Patent Number: 4,700,518

[45] Date of Patent: Oct. 20, 1987

[54] CONCRETE PANEL HAVING TILE DRIVEN

[75] Inventors: Shigeyuki Akihama, Chofu; Makoto Saito; Akio Kawamoto, both of Tokyo; Tadashi Banno, Chofu; Yoshihiko Umeki; Takumi Nakamura, both of Tokyo, all of Japan

[73] Assignee: Kajima Kensetsu Kabushiki Kaisha, Tokyo, Japan

[21] Appl. No.: 778,723

[22] Filed: Sep. 19, 1985

Related U.S. Application Data

[63] Continuation-in-part of Ser. No. 528,339, Aug. 31, 1983, abandoned.

[30] Foreign Application Priority Data

Sep. 3, 1982 [JP] Japan ..... 57-153671

[51] Int. Cl.[4] ..... E04C 1/00

[52] U.S. Cl. ..... 52/309.16; 52/309.17; 52/314; 52/600; 52/741

[58] Field of Search ..... 52/309.1, 309.16, 309.17, 52/596, 601, 600, 314, 747, 741

[56] References Cited

U.S. PATENT DOCUMENTS

| | | | |
|---|---|---|---|
| 2,414,011 | 1/1947 | Billner | 52/224 |
| 2,992,131 | 7/1961 | Bricknell | 427/327 |
| 3,513,609 | 5/1970 | Lang | 52/230 |
| 4,111,710 | 9/1978 | Pairaudeau et al. | 106/90 |
| 4,152,168 | 5/1979 | Yano et al. | 106/99 |
| 4,302,414 | 11/1981 | Curnow et al. | 264/137 |
| 4,314,003 | 2/1982 | Curnow et al. | 428/294 |
| 4,446,091 | 5/1984 | Pairaudeau et al. | 264/225 |
| 4,472,919 | 9/1984 | Nourse | 52/601 |

FOREIGN PATENT DOCUMENTS

| | | | |
|---|---|---|---|
| 2713090 | 9/1978 | Fed. Rep. of Germany | 52/309.17 |
| 27233 | 3/1978 | Japan | 52/309.17 |
| 78625 | 7/1978 | Japan | 52/309.16 |
| 73418 | 6/1979 | Japan | 52/596 |
| 2011520A | 7/1979 | United Kingdom | 52/309.17 |

OTHER PUBLICATIONS

Koncz, "Manual of Precase Concrete Construction", vol. 1, 1967, Table of Contents Pages VII–X; Text pp. 264, 265, 292 and 293.

*Primary Examiner*—John E. Murtagh
*Assistant Examiner*—Andrew Joseph Rudy
*Attorney, Agent, or Firm*—Body, Vickers & Daniels

[57] ABSTRACT

This invention is characterized by a concrete panel having tiles driven on the surface and carbon fibers mixed in the base material concrete and further including reinforcing iron materials being electrically isolated by a layer of material from the carbon fibers imbedded in the body of concrete. Said layer of material preventing corrosion of the iron materials.

10 Claims, 8 Drawing Figures

CONCRETE PANEL HAVING TILE DRIVEN

This application is a continuation-in-part of Ser. No. 06/528,339 filed Aug. 31, 1983 and now abandoned.

BACKGROUND OF THE INVENTION

1. Field of the Invention

This invention relates to a concrete panel having tiles preattached and driven on its surface used for the interior and exterior finishes of a building.

2. Description of the Prior Art

Conventionally were used a precast concrete panel having tiles driven for the interior and exterior finishes of a building, and a light weight concrete panel having tiles driven on a sheet of concrete (GFRC) reinforced by glass fibers. However, in the case of the former concrete panel, the thickness of a lining base material concrete is required to be 100–150 mm and the weight of same required to be about 250–350 $Kg/m^2$ for providing a predetermined performance so that cost for transporting and mounting the panel becomes high and the weight of the whole building is increased disadvantagously. Also in the case of the latter GFRC panel, the thickness of lining GFRC base material is generally 10–20 mm and the weight including tiles 100–150 $Kg/m^2$ so that the panel can be lightened compared with conventional concrete panels. However, since this GFRC panel uses prepared mortar rich in cement for the base material, it has larger rate of drying shrinkage compared with common concrete (common concrete$=(5-8)\times10^{-4}$, GFRC$\approx15\times10^{-4}$). Thus, the panel having tiles driven has large dimensional variation of GFRC at the rear surface, warping and twist, compared with the surface tile after manufacturing so that the tile is cracked by these warping and twist and the tile tends to be disadvantageously exfoliated.

To prevent large drying shrinkage of GFRC, the ratio of the shrinkage may be reduced by high temperature and pressure steam curing (generally steam with max. temperature and pressure of about 180° C. and 10 atmospheric pressure respectively is used). However, even if alkali resisting glass fibers were used for reinforcing glass fibers, it could not be cured by high temperature and pressure since it is remarkably degraded by temperature of 80° C. or more.

SUMMARY OF THE INVENTION

An object of this invention is to provide a concrete panel having tiles driven which has excellent dimensional stability and prevents exfoliation of the preattached tiles, occurrence of cracks, etc.

Another object of this invention is to provide a concrete panel having tiles driven which has high strength and can be thinned and lightened.

Still another object of this invention is to provide a concrete panel tiles driven which resists repeated load, has excellent weather-proof property and can be used for exterior finish of a building for a long time.

Yet another object of this invention is to provide a concrete building panel including reinforcing iron materials, reinforcing carbon fibers and pre-attached facing tiles in which the reinforcing iron materials are electrically isolated from the body of concrete to prevent corrosion of the iron materials due to electroconductivity of the carbon fibers.

BRIEF DESCRIPTION OF THE DRAWINGS

The features of the concrete panel having tiles driven according to this invention will be apparent from the following description with reference to the accompanying drawings, in which.

DETAILED DESCRIPTION OF PREFERRED EMBODIMENTS

Figure 1:
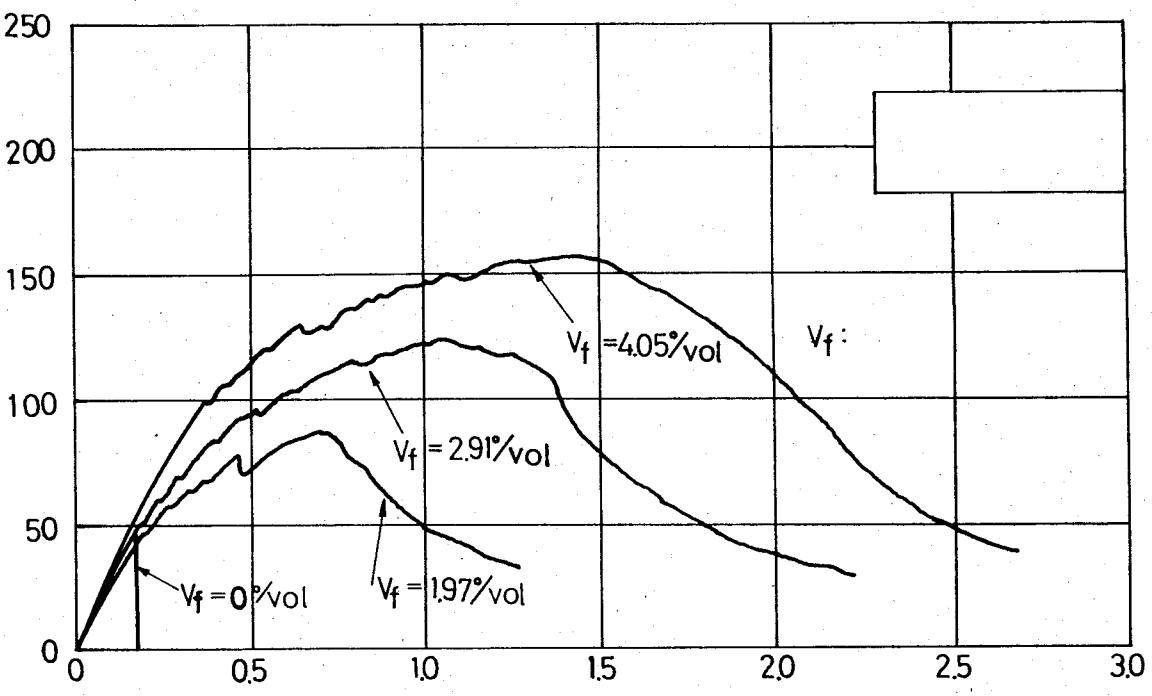
FIG. 1 shows a bending stress-deflection curve of a carbon filament reinforced concrete (CFRC) as a base material.
Figure 2:
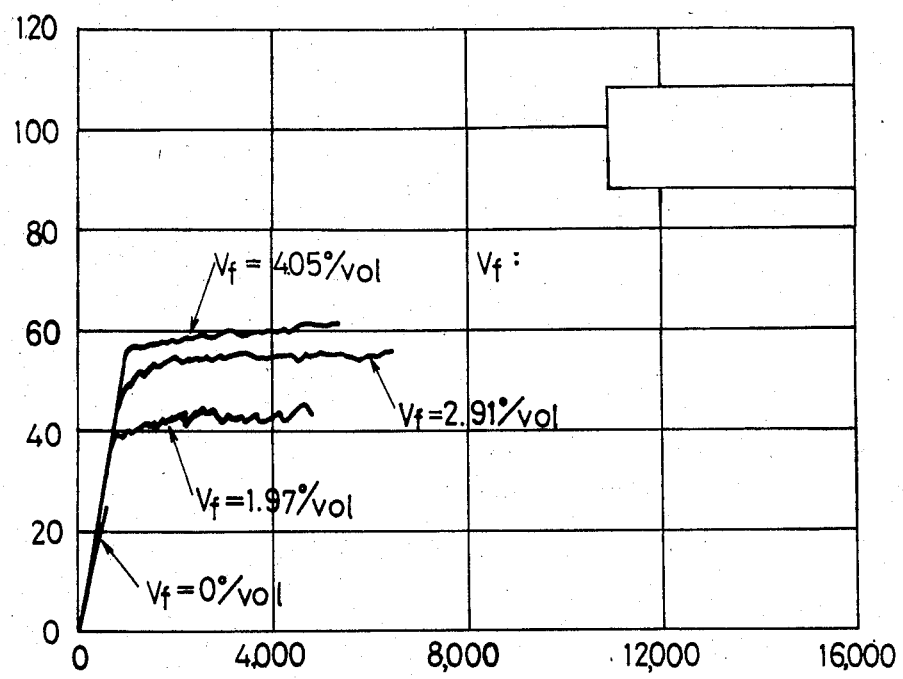
FIG. 2 shows a tensile stress intensity-strain curve of CFRC.
Figure 3:
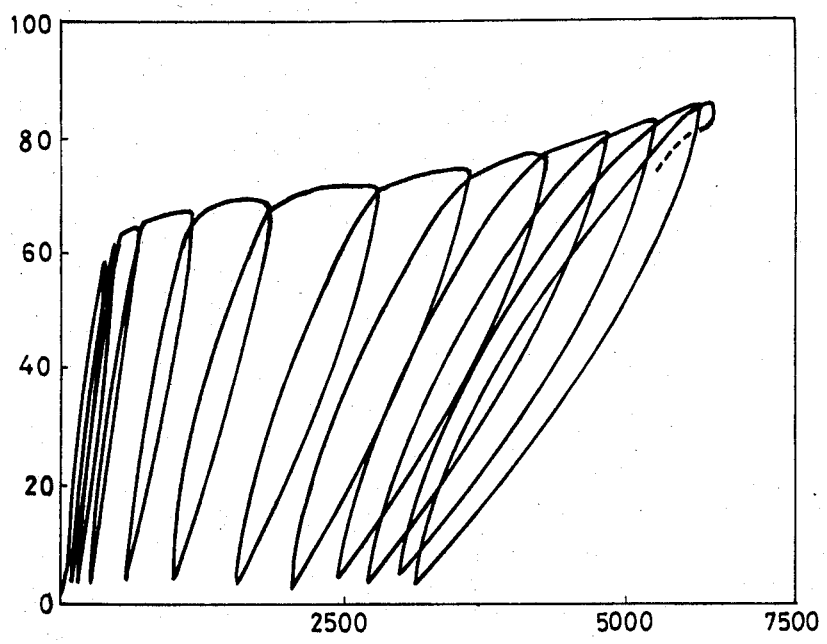
FIG. 3 shows a repeated tensile stress intensity-strain curve of CFRC.

A base material concrete of a concrete panel having tiles driven according to this invention is CFRC mixed with carbon filaments. The carbon filaments have extremely high tensile strength and tensile elastic modulus. Thus, as shown by the graph in FIGS. 1, 2 and 3, CFRC has high tensile strength and bending strength which have been never seen in prior concrete, and shows pseudo-elasticity-plasticity like that of metal material to repeated load. Hence, when CFRC panel is used for the outer wall or the like of a building, it displays high durability against repeated load due to wind load or the like.

Figure 4:
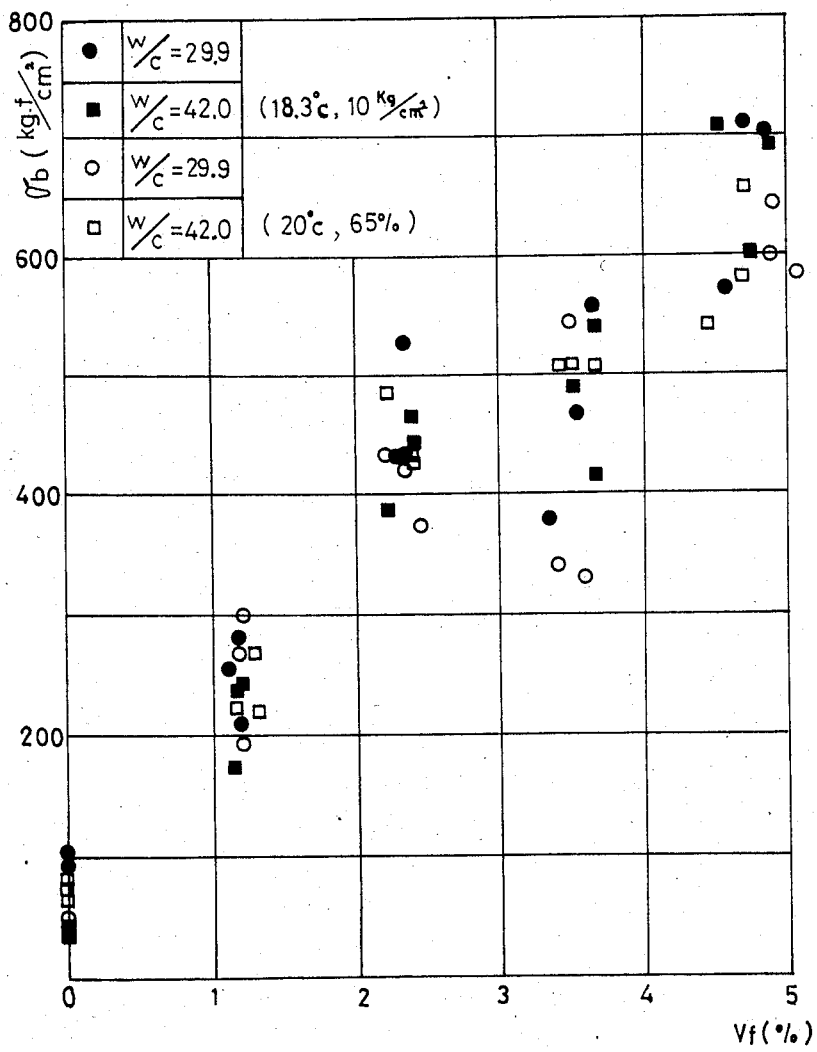
FIG. 4 is a correlation diagram of bending strength and carbon filament mixing ratio of CFRC cured by an autoclave and air.

FIG. 4 shows the relationship between carbon filament mixing ratio (Vf volume %) and bending strength of CFRC cured by an autoclave (cured by steam at 183° C. and 10 $Kg/cm^2$) and CFRC cured by air (20° C. and 65% RH). Degradation of strength due to the autoclave curing is not recognized. Generally, the bending strength and tensile strength are rather improved. Further, the results of said tests are values measured when dimension of a sample is $4\times1\times16$ cm and interval between supporting point is 10 cm.

Figure 5:
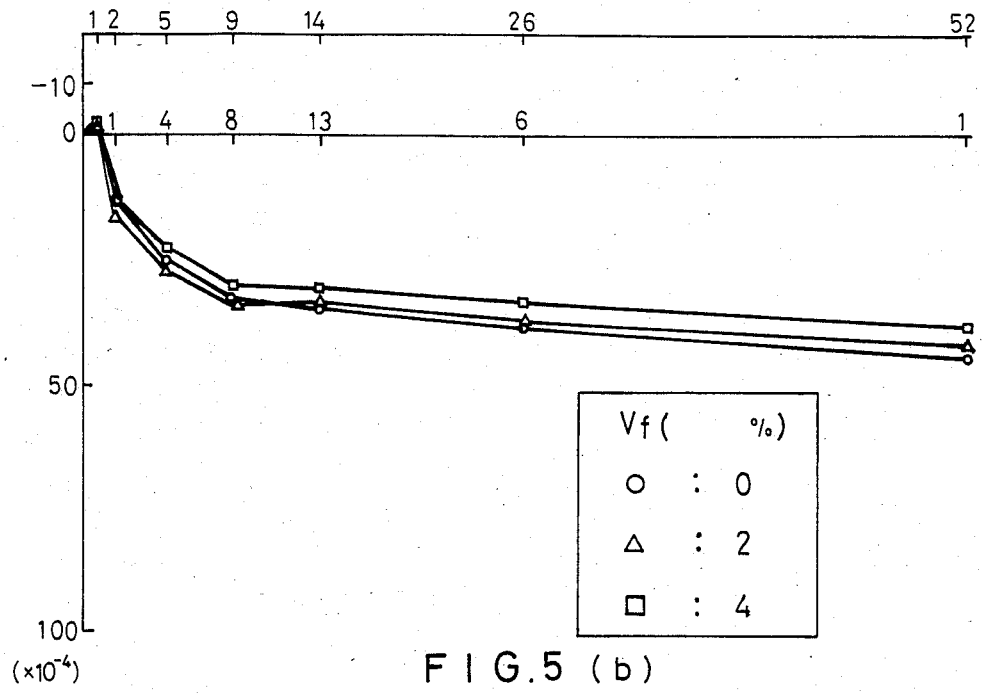
FIGS. 5(*a*), (*b*) are correlation diagrams of drying age and changing ratio of length of CFRC cured by water and an autoclave.
Figure 5:
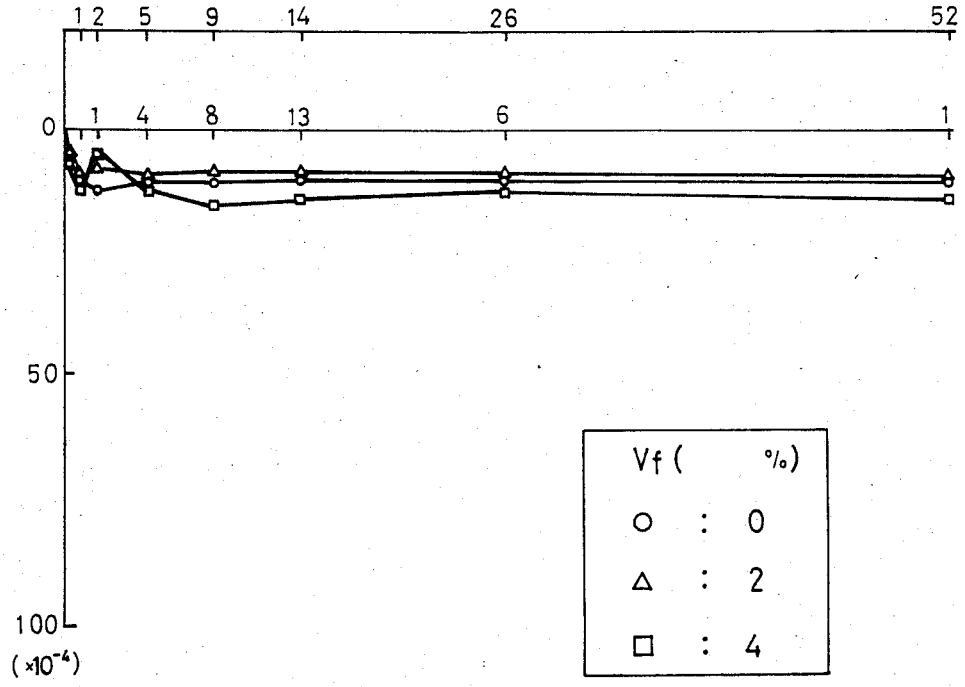

FIGS. 5(*a*), (*b*) are a graph showing the relationship between drying age and changing ratio of length when air cured CFRC and autoclave cured CFRC are left in air (20° C. and 65% RH). The autoclave cured one shown in FIG. 5(*b*) has extremely small drying shrinkage compared with the air cured one shown in FIG. 5(*a*). Thus, the autoclave cured tile panel produces little warping, deflection, crack or exfoliation of tile which present practical problems. Further, to provide smaller drying shrinkage ratio after the autoclave curing of CFRC, inflating agent used for conventional concrete may be added.

Figure 6:
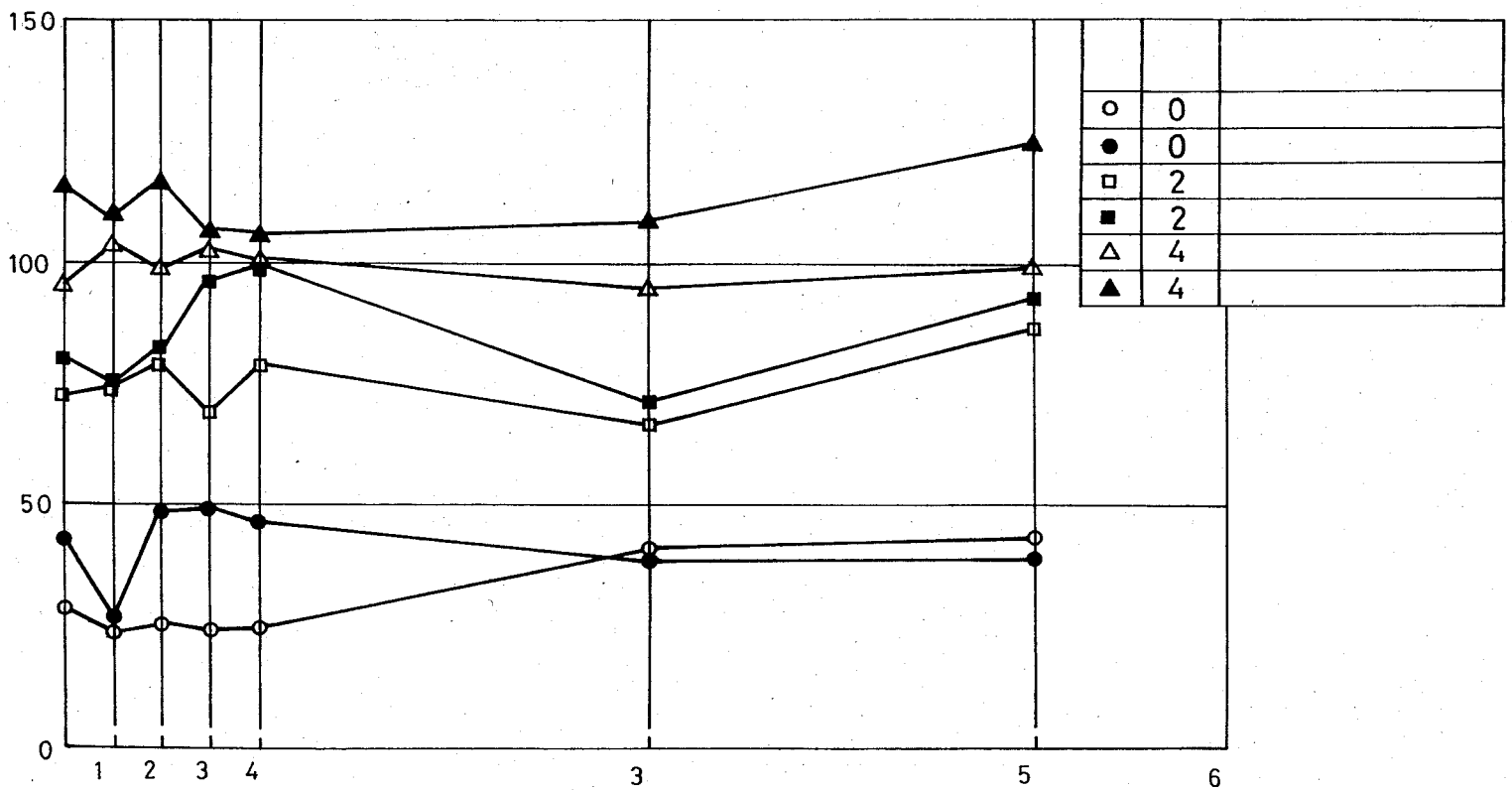
FIG. 6 is a correlation diagram of bending strength and age of CFRC immersed in water at 75° C.

While the tile panel is used for the exterior finish of a building, it may receive the direct rays of the sun to raise the temperature to 50°–70° C. at the back of the tile in the daytime. CFRC however produces no degradation under such high temperature. FIG. 6 shows the change of bending strength with the passage of time when CFRC is left in water at 75° C. for a long time.

Since the panel according to this invention has high strength, it can be lightened with thin thickness of plate. For example, like an example of preparing the following CFRC, specific gravity of base material can be lightened to about 1.0 by mixing light aggregate such as sand bar balloon with CFRC base material.

An example of preparing CFRC

| W/C (%) | Fiber mixing Ratio (%) | Carbon filament ($Kg/m^3$) | Cement ($Kg/m^3$) | Water ($Kg/m^3$) | Aggregate (Sand bar) balloon) ($Kg/m^3$) | Admixture ($Kg/m^3$) |
|---|---|---|---|---|---|---|
| 131 | 2 | 32.6 | 369 | 481 | 262 | 3.69 |

Also, CFRC for lining this tile panel may be further reinforced with reinforcing bars, mesh or shape steel, and inserts such as metal or plastic may be inserted between the back of tile and CFRC to maintain adhesive durability between the tile and CFRC for a long time.

For the carbon fibers used for CFRC according to this invention can be used high elasticity carbon fibers made of acryl fibers or the like baked at high temperature and having high strength an elastic modulus or low elasticity carbon fibers made from petroleum and coal pitch baked at relatively low temperature. The representative physical properties are as shown on the following table;

| | Tensile strength ($Kg/cm^2$) | Elastic modulus ($Kg/cm^2 \times 10^6$) | Specific gravity |
|---|---|---|---|
| High elasticity carbon fiber | 20,000–30,000 | 2.00–4.00 | 1.7–1.9 |
| Low elasticity carbon fiber | 8,000–11,000 | 0.43 | 1.6 |

The low elasticity carbon fiber is inferior to the high elasticity one with respect to the tensile strength and elastic modulus. It however is provided with performances necessary and sufficient for reinforcing the base material concrete of the tile panel and of low cost so that it is preferably used for the tile panel.

Figure 7:
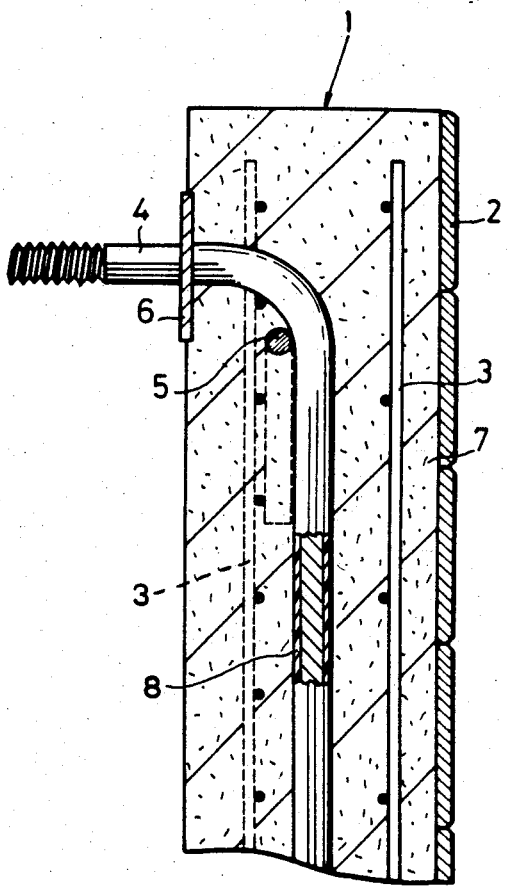
FIG. 7 is a cross-sectional elevation view of a tile faced reinforced concrete panel according to the present invention.

FIG. 7 illustrates a building panel as described hereinabove and wherein the carbon fiber reinforced concrete body is further reinforced by iron bars and rods which, in accordance with the invention, are covered with a layer of material which electrically isolates the iron reinforcing materials from the body of concrete to prevent corrosion of the iron materials during the process of cement hydration or autoclave curing of the body which would otherwise result from the electroconductivity of the reinforcing carbon fibers. More particularly, FIG. 7 shows a building panel comprising a body of concrete 1, reinforcing carbon fiber 7 therein, preattached facing tiles 2, and reinforcing iron materials at least partially embedded in the concrete. In the embodiment shown, such reinforcing iron materials include reinforcing bars or mesh 3, an anchor bolt 4 for fastening the building panel to a support, iron rod 5 and an iron facing plate 6 about bolt 4.

Reinforcing carbon fibers have good electroconductivity and electropotential, on the same order of that of precious metal, and form chemical cells between iron materials. Therefore, when the iron materials are in contact with a concrete compound including carbon fiber, corrosion of the iron materials occurs rapidly in connection with the process of cement hydration or autoclave curing of the concrete body. In order to prevent such corrosion of iron materials, at least the portions of the iron materials embedded in the concrete are provided with a layer of isolating material as shown by the numeral 8 in FIG. 7 with respect to iron rod 7. The isolating material has an electrical resistance above 100 ohms, and preferably above 500 ohms. Suitable materials for the isolating layer 8 include organic materials such as epoxy resin, acrylonitrile butadiene rubber, acrylonitrile-styrene-butadiene rubber and silicone resin, as examples, and inorganic materials such as cement mortar or paste, and ceramic dispersions such as $SiO_2$, $ZrO_2SiO_2$ or $SiC+ZrO_2SiO_2$ alcoholic dispersion. From the standpoint of the isolating property of the layer 8, facility of application and cost, epoxy resin and cement mortar or paste are preferred. In connection with the use of epoxy resin, for example, the surfaces of the iron materials are pre-treated such as by shot blasting, and the material is coated on the surfaces and then cured. The thickness of the isolating layer 8 is that required with the particular material being used to obtain the minimum resistance of 100 ohms referred to above. An epoxy resin layer 8 of 100 $\mu m$ thickness, for example, will provide the preferred electroresistance of above 500 ohms.

As above mentioned, this invention has the following effects;

(1) It provides a panel with low shrinkage ratio and high dimensional stability by high temperature and pressure steam curing without degradation of strength so that it can prevent the exfoliation of the file and the occurrence of cracks.

(2) It provides a panel which has high strength sufficient for resisting repeated load.

(3) It provides a panel which is not degraded even when it is used durably for the exterior finish material over a long period.

(4) It can lighten a panel, improve workability of the panel and reduce load of a building.

What is claimed is:

1. In a building panel comprising a body of concrete and pre-attached tiles providing a finished surface on said concrete, the improvement comprising: said body of concrete including reinforcing carbon fibers therein and reinforcing iron materials embedded therein, said carbon fibers having extremely low drying shrinkage ratio and high dimensional stability effectively preventing cracking and exfoliation of said tiles, and said reinforcing iron materials being electrically isolated from the said carbon fibers and protected from the corrosion promoting electroconductive action thereof by a layer of material on said iron materials having a thickness providing an electrical resistance above 100 ohms.

2. A building panel as defined in claim 1, wherein said layer of material is an epoxy resin.

3. A building panel as defined in claim 1, wherein said layer of material has an electrical resistance above 500 ohms.

4. A building panel as defined in claim 1, wherein said layer of material is an epoxy resin and said layer has a thickness of at least 100 $\mu m$.

5. A building panel as defined in claim 1, wherein said carbon fibers are high elasticity carbon fibers.

6. A building panel as defined in claim 1, wherein said carbon fibers are low elasticity carbon fibers.

7. A building panel as defined in claim 1, wherein the said body of concrete has a relatively low ratio of drying shrinkage less than approximately $15\times10^{-4}$.

8. A building panel as defined in claim 1, wherein the said body of concrete also contains a filling of a light aggregate material in an amount to lower the specific gravity of the concrete body to around 1.0.

9. A building panel as defined in claim 1, wherein the said tiles are attached to a front face of said body of concrete and said reinforcing iron materials include an anchor bolt embedded in said body of concrete and having a portion protruding from the back face of said body of concrete.

10. The method of fabricating a tile faced body of concrete having carbon fibers and reinforcing iron materials both embedded in said body of concrete and tiles press bonded to a face thereof, which method includes the step of applying a layer of material on said iron materials having a thickness providing an electrical resistance above 100 ohms to electrically isolate said iron materials from the said embedded carbon fibers.

* * * * *